US011534639B2

(12) United States Patent
Ernfjäll

(10) Patent No.: US 11,534,639 B2
(45) **Date of Patent: *Dec. 27, 2022**

(54) FIRE EXTINGUISHING SYSTEM

(71) Applicant: Fogmaker International AB, Växjö (SE)

(72) Inventor: Johnny Ernfjäll, Lammhult (SE)

(73) Assignee: Fogmaker International AB

( * ) Notice: Subject to any disclaimer, the term of this patent is extended or adjusted under 35 U.S.C. 154(b) by 137 days.

This patent is subject to a terminal disclaimer.

(21) Appl. No.: 15/033,028

(22) PCT Filed: Oct. 30, 2014

(86) PCT No.: PCT/EP2014/073353
§ 371 (c)(1),
(2) Date: Apr. 28, 2016

(87) PCT Pub. No.: WO2015/063219
PCT Pub. Date: May 7, 2015

(65) Prior Publication Data

US 2016/0279453 A1 Sep. 29, 2016

(30) Foreign Application Priority Data

Oct. 30, 2013 (EP) ..... 13190809

(51) Int. Cl.
*A62C 35/64* (2006.01)
*A62C 3/07* (2006.01)
(Continued)

(52) U.S. Cl.
CPC ..... *A62C 35/64* (2013.01); *A62C 3/07* (2013.01); *A62C 35/023* (2013.01); *A62C 37/44* (2013.01); *A62C 37/48* (2013.01)

(58) Field of Classification Search
CPC ..... A62C 35/02; A62C 35/023; A62C 37/44; A62C 35/68; A62C 3/07; A62C 35/64;
(Continued)

(56) References Cited

U.S. PATENT DOCUMENTS 3,034,502 A 5/1962 Lund
3,160,699 A 12/1964 Yamaji
(Continued)

FOREIGN PATENT DOCUMENTS

CN 103845833 A 6/2014
DE WO 2011/141361 * 11/2011 ..... A62C 35/64
(Continued)

OTHER PUBLICATIONS

Paul Bhadha, How Weld Hose Materials Affect Shielding Gas Quality, Jul. 1999, Welding Journal, pp. 35-37.*

*Primary Examiner* — Christopher R Dandridge
(74) *Attorney, Agent, or Firm* — Condo Roccia Koptiw LLP

(57) ABSTRACT

The present invention relates to a fire extinguishing system comprising a pressurized detection conduit (115), an extinguishing line (108) separate from the detection conduit (115), and a control module (105) adapted for sensing a pressure drop in the detection conduit (115) and for opening supply of extinguishing medium from a storage (103) to the extinguishing line (108). The detection conduit (115) is gas-permeable and filled with a detection liquid. The fire extinguishing system further comprises a liquid-gas interface (117) fluidly connecting the detection conduit (115) to a pressurized gas source (103, 106), wherein the liquid-gas interface (117) comprises an interface container (123) defining a gas space (131) which communicates with the pressurized gas source (106) and a liquid space (133) which communicates with the detection conduit (115).

18 Claims, 3 Drawing Sheets

(51) Int. Cl.
*A62C 37/44* (2006.01)
*A62C 37/48* (2006.01)
*A62C 35/02* (2006.01)

(58) Field of Classification Search
CPC ..... A62C 37/48; A62C 35/11; A62C 35/13; G01L 19/12
See application file for complete search history.

(56) References Cited

U.S. PATENT DOCUMENTS 3,827,502 A * 8/1974 Lockwood ..... A62C 35/10 169/51
4,297,687 A * 10/1981 Fuzzell ..... A62C 37/50 116/70
4,728,940 A 3/1988 Stoll et al.
5,276,433 A 1/1994 Booker et al.
5,621,389 A * 4/1997 Fellows ..... G08B 17/04 337/320
5,954,138 A 9/1999 Gabriel
6,059,046 A * 5/2000 Lowry ..... A62C 37/10 169/61
6,161,624 A * 12/2000 Bennett ..... A62C 3/07 169/58
8,336,733 B2 * 12/2012 Laws ..... B01F 15/0205 141/17
2004/0084193 A1 * 5/2004 Tseng ..... A62C 37/10 169/62
2005/0269109 A1 * 12/2005 Maguire ..... A62C 99/0018 169/43
2009/0101680 A1 4/2009 Laws et al.
2011/0083864 A1 * 4/2011 Smith ..... A62C 37/48 169/56
2013/0062079 A1 * 3/2013 Bermes ..... A62C 35/68 169/19

FOREIGN PATENT DOCUMENTS

EP 2308567 A2 4/2011
GB 2252163 * 7/1992 ..... G01K 11/04
GB 2252163 A 7/1992
JP S54-29687 U 2/1979
JP S54-30876 U 2/1979
JP S61-193677 A 8/1986
JP 2001-198233 A 7/2001
WO WO2011/141361 * 11/2011 ..... A62C 35/64
WO WO 2011/141361 11/2011
WO WO2013104351 * 7/2013 ..... A62C 3/07

* cited by examiner

FIRE EXTINGUISHING SYSTEM

CROSS REFERENCE TO RELATED APPLICATIONS

This application is the National Stage Entry under 35 U.S.C. § 371 of Patent Cooperation Treaty Application No. PCT/EP2014/073353, filed Oct. 30, 2014 which claims the benefit of EP Patent Application 13190809.7, filed Oct. 30, 2013, the contents of which are hereby incorporated by reference herein.

FIELD OF THE INVENTION

The present invention relates to a fire extinguishing system comprising a pressurized detection conduit, an extinguishing line separate from the detection conduit, and a control module adapted for sensing a pressure drop in the detection conduit and for opening supply of extinguishing medium from a storage to the extinguishing line.

BACKGROUND OF THE INVENTION

A fire extinguishing system of this type may be used, e.g., in vehicle engine compartments. A detection conduit of the extinguishing system is normally located in the upper part of the engine compartment and in the event of fire in the engine compartment the detection conduit bursts due to heat generated by the fire. It is realised that such a fire extinguishing system is exposed to a wide range of temperature conditions.

WO 2011/141361 A1 discloses a fire extinguishing system which comprises a pneumatic detection system for detecting a fire and initiating an extinguishing sequence. This extinguishing system comprises a gas-tight detection tube which is filled with pressurized gas. In the event of fire the detection conduit bursts due to heat generated by the fire. Then the pressure in the detection tube falls due to leakage of gas. The depressurization of the detection tube automatically initiates the extinguishing sequence.

This fire extinguishing system has the drawback that the robustness with respect to different temperature conditions may be regarded as relatively poor.

SUMMARY OF THE INVENTION

It is an object of the present invention to overcome the above described drawback, and to provide an improved fire extinguishing system.

This and other objects that will be apparent from the following summary and description are achieved by a fire extinguishing system according to the appended claims.

According to one aspect of the present disclosure there is provided a fire extinguishing system comprising a pressurized detection conduit, an extinguishing line separate from the detection conduit, and a control module adapted for sensing a pressure drop in the detection conduit and for opening supply of extinguishing medium from a storage to the extinguishing line, wherein the detection conduit being gas-permeable and filled with a detection liquid, and the fire extinguishing system further comprising a liquid-gas interface fluidly connecting the detection conduit to a pressurized gas source, wherein the liquid-gas interface comprises an interface container defining a gas space which communicates with the pressurized gas source and a liquid space which communicates with the detection conduit.

The control module is configured to sense a pressure change and respond to the change in a specified manner, namely by opening supply to a storage of extinguishing medium. The control module may also be configured to activate an alarm system. Extinguishing medium, such as e.g. water mist under high pressure, is then discharged through the extinguishing line.

The fire extinguishing system may e.g. be installed in a vehicle engine compartment. Typically, the temperature in such an engine compartment reaches 120-150° C. under normal operation of the engine. Hence, the detection conduit needs to be able to withstand relatively high temperatures without bursting. To work properly, i.e. not burst due to heat generated under normal operating conditions, the detection conduit thus need to be able to withstand relatively high temperatures.

The interface container is connected to each of the pressurized gas source and the liquid-filled detection conduit. The interface container is thus adapted to hold detection liquid in the liquid space and pressurized gas in the gas space. Gas is a compressible fluid and a gas volume with a certain pressure may thus be compressed to a smaller gas volume having higher pressure. On the contrary liquid is an incompressible fluid and a liquid-filled detection conduit itself is thus not able to compensate for pressure variations caused by temperature variations. However, the gas in the interface container may be compressed which allows detection liquid to flow from the detection conduit to the interface container to compensate for temperature variations. Hence, a significant pressure increase in the detection conduit caused by raised temperature may be avoided. The volume of each of the gas space and the liquid space is thus not constant but may vary slightly in response to varying ambient temperature and/or varying operating conditions of an engine where the detection conduit is installed.

The liquid-gas interface thus enables the use of a liquid-filled detection conduit instead of a gas-filled detection conduit. To work properly the detection conduit must thus be liquid-tight. However, the detection conduit does not need to be gas-tight, which means that other, more heat resistant material can be used to form the detection conduit. Since the detection conduit does not need to be gas-tight more freedom in choosing the detection conduit material is thus achieved. Hence, the detection conduit may be formed from a material that does not dry and crack and that withstands higher temperature than the material of a gas-tight detection conduit. Thus, a liquid-filled detection conduit can withstand significantly higher temperatures than a gas-filled detection conduit since a liquid-filled detection conduit can be formed from a more heat resistant material. This fire extinguishing system thus has the advantage that it can operate in a wide range of temperature conditions. For instance, it can be installed in an engine compartment where the temperature may reach 150° C. under normal operating conditions.

According to one embodiment the gas space and the liquid space are separated from each other by a piston displaceably arranged in the interface container. This embodiment has the advantage that the interface container may be installed in any direction if the piston is sealed with regard to the inner wall of the interface container. Furthermore, such a piston may hold a position sensor for monitoring the detection fluid level in the interface container.

According to one embodiment the piston is adapted to float on the liquid detection liquid the interface container. Such a piston may hold a sensor for monitoring the detection fluid level in the interface container. This embodiment has the advantage that the detection fluid level in the interface container may be monitored although the piston is not sealed with regard to the inner wall of the interface container.

According to one embodiment the interface container is formed from stainless steel.

According to one embodiment the piston comprises a position sensor, such as e.g. a magnet, for monitoring the position of the piston in the interface container. This enables to monitor the position of the piston in an easy manner.

According to one embodiment the piston is sealed with regard to the inner wall of the interface container in order to enable the interface container to be installed in any direction.

The detection conduit is preferably formed from a thermoplastic material, such as a thermoplastic fluoropolymer. This has the advantage that the detection conduit may resist relatively high temperatures which is advantageous in applications where the normal operating temperature is relatively high.

According to a preferred embodiment the gas-permeable detection conduit is formed from ETFE due to the mechanical properties and ability to resist relatively high temperatures of this material.

According to one embodiment the control module comprises a pressure regulator adapted for maintaining the pressure in the detection conduit at a predetermined level. The pressure regulator thus reduces the pressure of the pressurized gas source to a pressure level adapted for the detection conduit. This has the advantage that driving gas, i.e. a pressurized gas source configured to drive extinguishing medium out from a storage thereof, or gaseous extinguishing medium, may be utilized to pressurize the detection conduit.

According to one embodiment the fire extinguishing system comprises a dip tube arranged for supplying extinguishing medium from the storage to the extinguishing line.

Preferably, the dip tube extends to the bottom of the extinguishing medium storage.

According to one embodiment the fire extinguishing system further comprises a pressure controller arranged to monitor the pressure in the detection conduit.

The pressure controller may comprise a pressure switch arranged to activate an alarm system when the pressure in the detection conduit falls below a predetermined value. This has the advantage that e.g. an operator may be alerted in the event of fire.

According to one embodiment the interface container is circular cylindrical.

BRIEF DESCRIPTION OF THE DRAWINGS

The invention will now be described in more detail with reference to the appended drawings in which.

DESCRIPTION OF PREFERRED EMBODIMENTS

Figure 1:
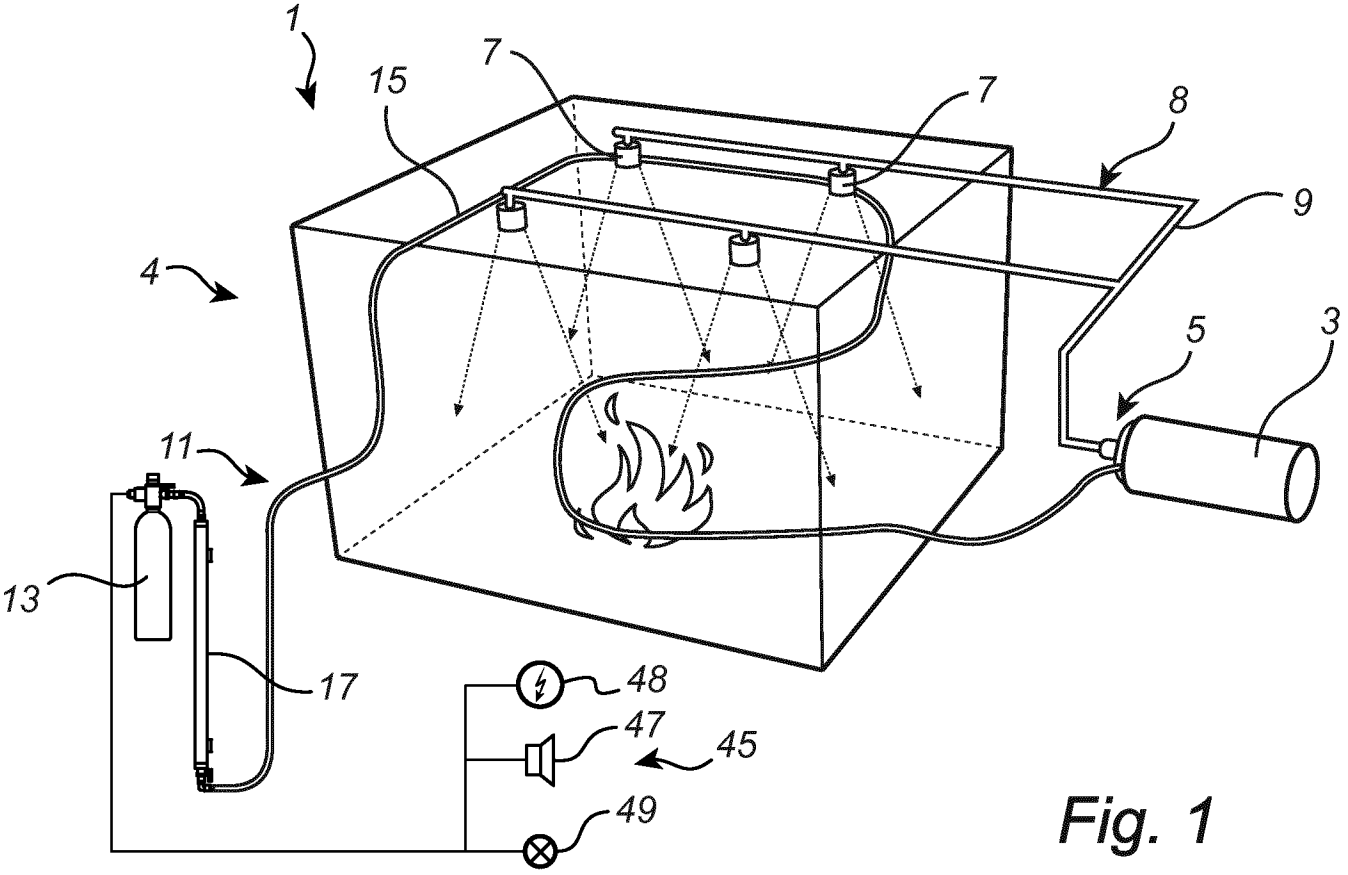
FIG. 1 is a schematic perspective view of a fire extinguishing system according to an embodiment of the present disclosure.

FIG. 1 illustrates a fire extinguishing system 1 according to an embodiment of the present disclosure. The fire extinguishing system 1 may e.g. be installed in the engine compartment 4 of a vehicle (not shown), as schematically illustrated in FIG. 1. On release of the extinguishing system 1 extinguishing liquid in the form of atomised mist is sprayed in the engine compartment 4 to cool and extinguish the fire.

The extinguishing system 1 comprises a pressure container 3 for extinguishing liquid, a control module in the form of a release valve 5, an extinguishing line 8 and a detection system 11. The extinguishing line 8 comprises several nozzles 7 and a piping system 9. The detection system 11 comprises a pressurized liquid-filled detection conduit 15. Each of the extinguishing line 8 and the detection conduit 15 is connected to the release valve 5.

The pressure container 3 is of a design known per se and forms two chambers, a first chamber for extinguishing liquid and a second chamber for a driving gas. The pressure container chambers are separated from each other by means of a piston displaceably arranged in the pressure container 3 and sealed with regard to the cylindrical wall by means of sealing rings. On delivery the extinguisher container 3 is filled with extinguishing fluid and drive gas to approximately 105 bars.

The release valve 5 is arranged to open supply of extinguishing liquid from the pressure container 3 to the extinguishing line 8 in response to a pressure drop in the detection conduit 15 caused by rupture of the detection conduit 15. When the release valve 5 is opened extinguishing liquid is discharged from the pressure container 3 to the extinguishing line 8 through a discharge opening of the release valve 5.

Figure 2:
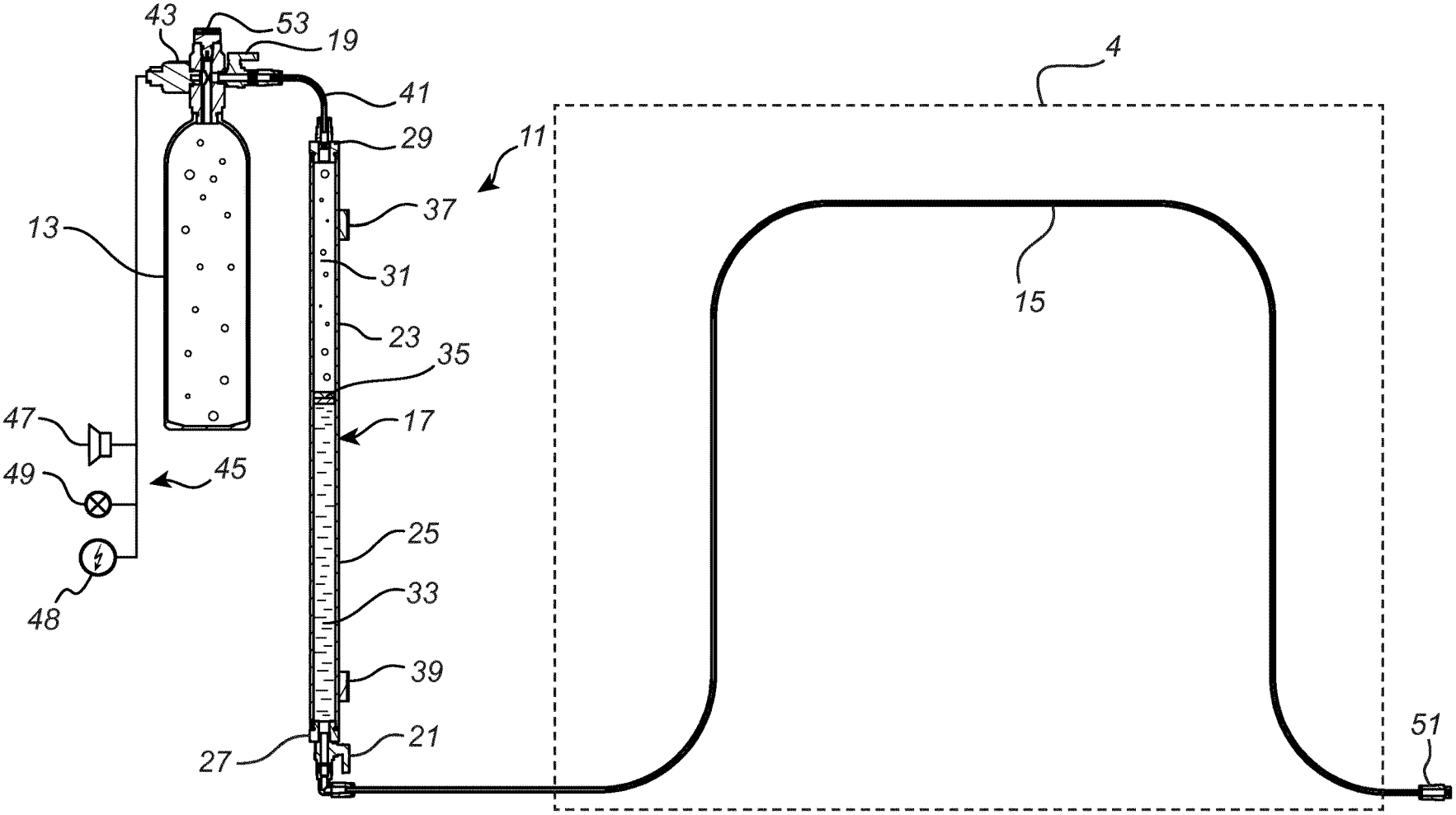
FIG. 2 shows a part of the fire extinguishing system of FIG. 1.

FIG. 2 illustrates the detection system 11 of the fire extinguishing system 1 shown in FIG. 1. The detection system 11 comprises a gas container 13 for holding pressurized gas, the liquid-filled detection conduit 15 and a liquid-gas interface 17 fluidly connecting the liquid-filled detection conduit 15 to the gas container 13. The detection conduit 15 is gas-permeable.

A first valve 19, in the form of a ball valve, is arranged to control the flow of pressurized gas between the gas container 13 and the liquid-gas interface 17. When the first valve 19 is opened the gas container 13 fluidly communicates with the liquid-gas interface 17. A second valve 21 is arranged to control flow of liquid between the liquid-gas interface 17 and the liquid-filled detection conduit 15. When the second valve 21 is opened the liquid-gas interface 17 fluidly communicates with the detection conduit 15. When the detection system 11 is activated each of the first 19 and second 21 valves is set in an open position.

In this embodiment the gas container 13 is filled with Nitrogen gas pressurized to approximately 24 bar. Alternatively, the gas container may be filled with, e.g., Carbon dioxide or Argon.

The liquid-gas interface 17 comprises a cylindrical pressure container, in the form of a steel tube 23, which is also referred to as interface container. The interface container 23 comprises a cylindrical wall 25, a lower end wall 27 and an upper end wall 29. The interface container 23 forms two spaces, a first space 31 for pressurized gas and a second space 33 for detection liquid. The gas space 31 and the liquid space 33 may be separated from each other by a piston. In this embodiment the gas space 31 and the liquid space 33 are separated from each other by a piston 35 in the form of a floating disc shaped element that floats on the surface of the detection liquid in the interface container 23. In this embodiment, the piston 35 is not sealed against the cylindrical wall 25. The interface container 23 is therefore arranged in an upright position with the gas space 31 located above the liquid space 33, i.e. with the gas space 31 at a higher vertical level than the liquid space 33. Alternatively, the piston 35 may be sealed against the cylindrical wall 25. Then, the interface container 23 may be arranged in any position, i.e. horizontally or with the liquid space 33 located above the gas space 31.

The piston 35 is magnetic and the liquid-gas interface 17 further comprises a first magnetic switch 37 which is activated when the magnetic piston 35 reaches a predetermined upper level and a second magnetic switch 39 which is activated when the piston 35 reaches a predetermined lower level. The magnetic switches 37, 39 serve to monitor the position of the piston 35 in the interface container 23.

The upper end wall 29 of the interface container is connected to the first valve 19 by means of a gas-tight tube portion 41. When the first valve, i.e. the valve mounted on the gas container 13, is set in an open position the gas container 13 fluidly communicates with the first chamber 31 of the interface cylinder 23 via the tube portion 41

The second valve 21, to which the detection conduit 15 is connected, is arranged at the lower end wall 27 of the interface container 23. The second valve 21 thus controls flow of detection liquid between the liquid space 33 of the interface container 23 and the detection conduit 15. When the second valve 21 is set in an open position the liquid space 33 fluidly communicates with the detection conduit 15 and detection fluid may flow into and out from the detection conduit to compensate for pressure variations. Since gas is a compressible fluid the gas volume in the interface container 23 may be compressed to a smaller volume with higher pressure. This enables to avoid a significant pressure increase in the detection conduit 15, which is filled with an incompressible fluid, caused by raised temperature where the detection conduit 15 is installed. Hence, the volume of each of the gas space 31 and the liquid space 33 is not constant but may vary slightly in response to varying ambient temperature and/or varying operating conditions of an engine where the detection conduit 15 is installed.

A pressure controller, in the form of a pressure switch 43, is arranged to sense the pressure in the detection system 11. The pressure switch 43, which is mounted on the interface cylinder 23, is connected to a fire alarm system 45 that generates an audible and/or a visible alarm when activated, i.e. when a fire is detected by the detection system 11. To this end the fire alarm system 45 comprises an audible alarm unit 47 and a visible alarm unit 49, as schematically illustrated in FIGS. 1 and 2. The pressure switch 43 is configured to activate the alarm system 45 if the pressure in the detection system falls below a predetermined value. For instance, the pressure switch 43 may be configured to activate the alarm system 45 if the pressure in the detection conduit 15 falls below 4 bar.

The detection system 11 comprises an end plug 51 for connecting the detection conduit 15 to the release valve 5 of the fire extinguishing system, as illustrated in FIG. 1. The end plug 51 is arranged at one end of the detection conduit 15 and is connected to the extinguishing system 1 in a known manner.

The pressure controller 43 may be configured to generate an electric trigger signal 48, as schematically illustrated in FIGS. 1-2, for activation of the release valve 5. Furthermore, the pressure controller 43 may be configured to generate signal(s) for functions such as automatic engine shut-off, fuel shut-off and power shut-off.

The detection system 11 further comprises a pressure gauge 53 showing the actual pressure of the gas in the detection system gas cylinder 13.

The fire extinguishing system 1 may be installed in many different applications. The ambient temperature where the system is installed may vary between e.g. −20° C. to 60° C. If the system 1 is installed in a vehicle compartment 4 the ambient temperature may be even higher, such as e.g. 150° C., due to heat generated by the engine. Hence, the detection conduit 15 must be able to withstand a relatively high temperature. Preferably, the detection conduit 15 is formed from a thermoplastic fluoropolymer, such as e.g. ETFE, which has suitable mechanical properties and a relatively high heat resistance. Variations of the ambient temperature in the engine compartment 4 cause pressure variations in the interface cylinder 23 since the gas pressure will be higher at a higher ambient temperature than at a lower ambient temperature. The volume of each of the gas space 31 and the liquid space 33 may thus vary slightly in response to varying ambient temperature and/or varying operating conditions of the engine.

The detection system 11 may e.g. be installed in a bus engine compartment. In the event of fire in the engine compartment 4 where the detection system 11 is installed the detection conduit 15 burst due to heat generated by the fire. Consequently, detection liquid and gas leak from the detection conduit 15. Then, the pressure in the detection conduit 15 drops. When the pressure in the detection conduit 15 has fallen to a predetermined value the release valve 5 on the extinguishing liquid container 3 is activated, i.e. supply to extinguishing liquid from the storage 3 is opened, and the fire extinguishing liquid is released from the pressure container 3. Then extinguishing liquid is sprayed into the engine compartment 4 through the nozzles 7 of the extinguishing line 8 in order to extinguish the fire, as schematically illustrated by the dashed arrows in FIG. 1. Also, the pressure switch 43 activates the alarm system 45 to alert an operator, e.g. a bus driver, that a fire in the engine has been detected in the compartment 4.

Figure 3:
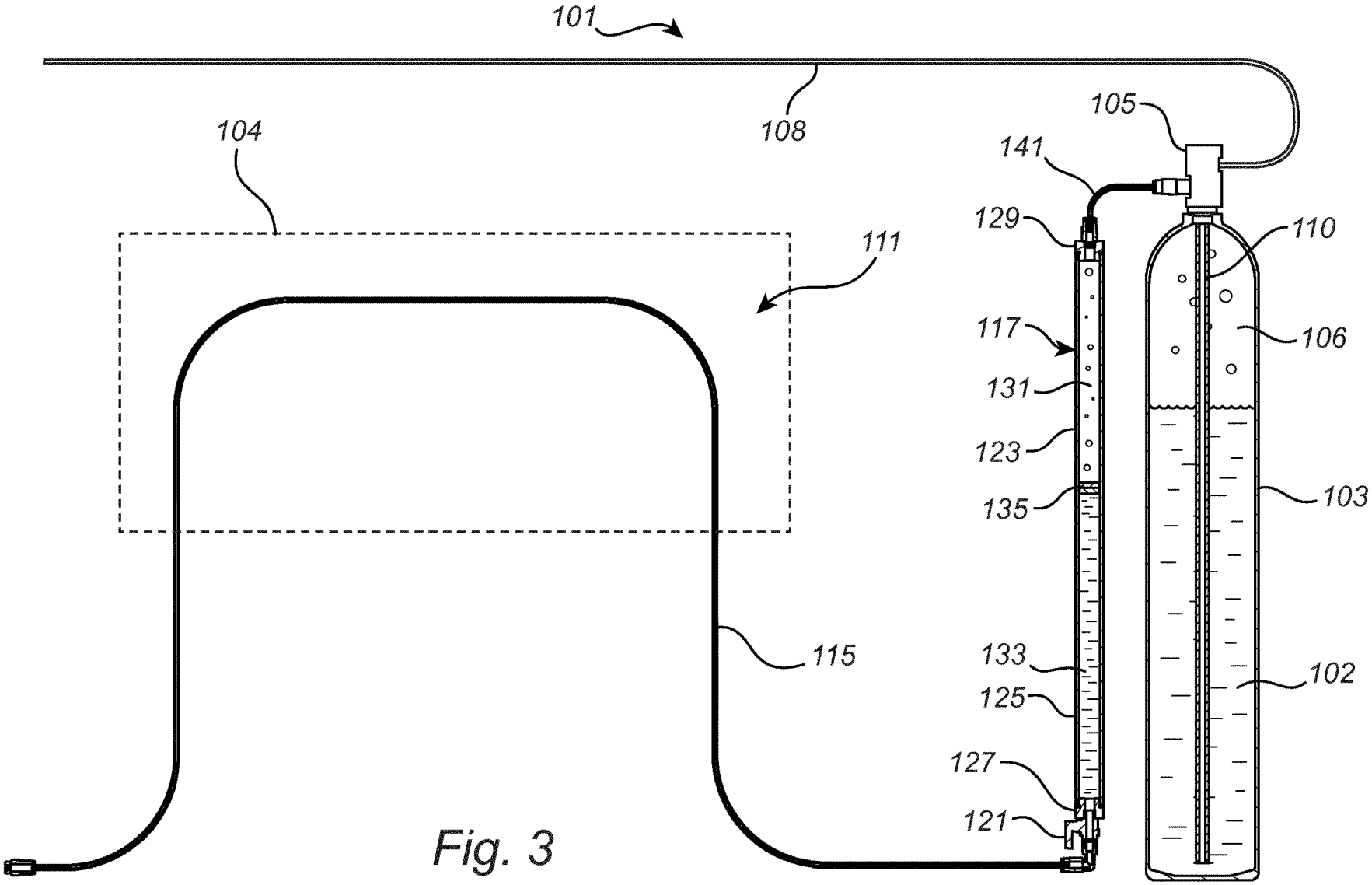
FIG. 3 is a schematic side view of a fire extinguishing system according to an alternative embodiment of the present disclosure.

FIG. 3 illustrates a fire extinguishing system 101 according to a second embodiment of the present disclosure. The fire extinguishing system 101 may e.g. be installed in the engine compartment 104 of a vehicle. On release of the extinguishing system 101 extinguishing liquid in the form of water mist is sprayed into the compartment 104 to cool and extinguish the fire.

The extinguishing system 101 comprises a pressure container 103, for storing pressurized extinguishing liquid 102, a control module 105, an extinguishing line 108 for discharging extinguishing liquid 102 and a liquid-filled detection conduit 115. The detection conduit 115 is gas-permeable.

The extinguishing fluid 102 is pressurized to approximately 100 bar by a driving gas 106, such as e.g. Nitrogen. The pressure within the pressure container 103 is thus approximately 100 bar.

The fire extinguishing system 101 further comprises a liquid-gas interface 117 fluidly connecting the detection conduit 115 to the control module 105 via a gas-tight tube portion 141.

The control module 105, which is known per se, is adapted for sensing a pressure drop in the detection conduit 115 and for opening supply of extinguishing medium 102 from the pressure container 103 to the extinguishing line 108 of the control module 105.

The control module 105 comprises a release valve (not shown) which is arranged to open supply of extinguishing liquid 102 from the pressure container 103 to the extinguishing line 108 in response to a pressure drop in the detection conduit 115 caused by rupture of the detection conduit 115. When the release valve is opened extinguishing liquid 102 is discharged from the pressure container 103 to the extinguishing line 8 through a discharge opening of the release valve.

The control module 105 further comprises a pressure regulator (not shown) for controlling the pressure in the detection conduit 115. The pressure regulator fluidly connects the liquid gas interface 117 to the pressurized gas source 106 stored in the pressure container 103 and serves to pressurize the detection conduit 115 to a pressure which is significantly lower than the pressure in the pressure container 103. Typically, the pressure in the detection conduit 115 is approximately 24 bar and the pressure in the pressure container 103 is approximately 100 bar. The pressure in the detection conduit 115 is thus established by the pressure regulator of the control module 105, which reduces the higher gas pressure in the pressure container 103 to establish a lower pressure in the detection conduit 115. If the pressure in the extinguishing medium container 103 changes due to temperature variations, the pressure regulator maintains the internal pressure in the detection conduit 115 at a substantially constant predetermined level. Hence, the liquid gas interface 117 is thus fluidly connected to the pressurized gas source of the pressure container 103 via the pressure regulator.

The fire extinguishing system 101 further comprises a dip tube 110 which is connected to the release valve of the control module 105 and extends to the bottom of the pressure container 103 so that, in an upright position, the opening of the dip tube is submerged in the extinguishing liquid 102 stored in the pressure container 103, as illustrated in FIG. 3.

The extinguishing line 108 is connected to the release valve of the control module 105 and the release valve is fluidly connected to the dip tube 110 for discharging extinguishing fluid 102 from the container 103 to the extinguishing line 108 upon activation of the release valve, i.e. when the pressure in the detection conduit 115 falls below a predetermined value.

The liquid-gas interface 117 comprises a pressure container, in the form of a steel cylinder 123, which is also referred to as interface container. The interface container 123 comprises a cylindrical wall 125, a lower end wall 127 and an upper end wall 129. The interface container 123 forms two spaces, a first space 131 for pressurized gas and a second space 133 for detection liquid. The gas space 131 and the liquid space 133 are separated from each other by a piston 135 displaceably arranged in the interface container 123. The piston 135 may be sealed with regard to the cylindrical wall 125 by means of sealing rings.

The upper end wall 129 of the interface container is connected to the pressure controller by means of a gas-tight tube portion 141.

A valve 121, in the form of a ball valve, is arranged to control the flow of detection liquid between the interface container 123 and the detection conduit 115. When the detection system 111 is activated the valve 121 is set in an open position. Then the detection conduit 115 fluidly communicates with the liquid-gas interface 117 and detection fluid may flow into and out from the detection conduit 115 to compensate for pressure variations. Since gas is a compressible fluid the gas volume in the interface container 123 may be compressed to a smaller volume with higher pressure. This enables to avoid a significant pressure increase in the detection conduit 115, which is filled with an incompressible fluid, caused by raised temperature where the detection conduit 115 is installed. Hence, the volume of each of the gas space 131 and the liquid space 133 is not constant but may vary slightly in response to varying ambient temperature and/or varying operating conditions of an engine where the detection conduit 115 is installed.

In the event of fire in the compartment where the detection conduit 115 is installed the detection conduit 115 bursts due to heat generated by the fire. Consequently, detection liquid leaks from the detection conduit 115. Then, the pressure in the detection system 111 drops. When the pressure in the detection system 111 has fallen below a predetermined value the release valve of the control module 105 is activated. Then, supply to the extinguishing liquid 102 is opened, i.e. the extinguishing line 108 fluidly communicates with the extinguishing medium container 103, allowing extinguishing liquid 102 to be discharged under the action of the pressurized driving 106 gas in the pressure container.

Hence, the fire extinguishing system 101 comprises the pressure container 103 for holding pressurized gas, the control module 105, the liquid-filled detection conduit 115 and the liquid-gas interface 117 connecting the liquid-filled detection conduit 115 to the pressure cylinder 103.

The pressure regulator of the control module 105 is arranged between the pressure container 103 and the liquid-gas interface 117 and thus enables the detection conduit 115 to be operated at a significantly lower pressure level than the pressure in the extinguishing medium container 103. For instance the pressure of the detection conduit 115 may be about 24 bar while the extinguishing fluid in the pressure container 103 is pressurized to about 100 bar.

It will be appreciated that numerous variants of the embodiments described above are possible within the scope of the appended claims.

Hereinbefore it has been described, with reference to FIGS. 1-3, that the gas space and liquid space of the interface container may be separated from each other by a piston displaceably arranged in the interface container. In an alternative embodiment the gas space and liquid space are separated from each other by a piston displaceably arranged in the interface container and sealed with regard to the cylindrical wall 25 by means of sealing rings.

Hereinbefore it has been described that the gas space and the liquid space may be separated from each other by a piston. It is appreciated that the gas space and the liquid space must not be separated by a piston. When the interface container has no piston separating the gas space and the liquid space from each other the interface cylinder need to be installed in a certain direction, e.g. upright with the gas space at a higher level than the liquid space to pressurize the detection conduit in a proper manner.

Hereinbefore it has been described, with reference to FIG. 3, that the extinguishing medium may be a fluid in the form of a liquid. It is appreciated that the extinguishing medium may be a fluid in the form of a gas, such as, e.g., Carbon dioxide, Nitrogen, Argon or compressed air.

Hereinbefore it has been described that the detection conduit is connected to the release valve of the extinguishing system and that the release valve is activated in response to a pressure drop in the detection conduit caused by rupture of the detection conduit. It is appreciated that the release valve may be configured to be activated by an electric trigger signal 48, illustrated in FIGS. 1-2, generated by the control module in response to a pressure drop in the detection conduit caused by rupture of the detection conduit. In case the release valve is arranged to be activated by such an electric trigger signal the detection conduit must not be connected to the release valve. A fire extinguishing system according to the present disclosure may thus be activated hydro pneumatically, as described hereinbefore with reference to FIGS. 1-3, and/or electrically by means of an electric trigger signal generated by the control module.

The invention claimed is:

1. A fire extinguishing system for a vehicle engine compartment, comprising:

a pressurized container containing an extinguishing liquid, wherein the pressurized container is disposed outside of the engine compartment;

a release valve connected to the pressurized container for supplying the extinguishing liquid to an extinguishing line and to a detection conduit formed from a thermoplastic fluoropolymer, wherein the detection conduit is at least partially disposed in the vehicle engine compartment, is filled with a liquid, and is not gas-tight;

a detection system coupled to the detection conduit, the detection system comprising an interface container to pressurize a gas to maintain the liquid in the detection conduit, and a pressure controller to monitor a pressure associated with the interface container, wherein the release valve is configured to release the extinguishing liquid to the extinguishing line when a liquid-gas interface in the interface container falls below a predetermined pressure, and wherein the pressure controller is configured to generate an electric trigger signal to activate a shut-off function if a pressure in the detection conduit falls below a predetermined value, wherein the shut-off function provides an automatic shut-off of a fuel.

2. The fire extinguishing system of claim 1, wherein the detection conduit is coupled at a first end to the release valve and at a second end to the interface container.

3. The fire extinguishing system of claim 1, wherein the interface container is interposed between the detection conduit and the release valve.

4. The fire extinguishing system of claim 1, wherein the interface container is disposed outside of the engine compartment.

5. The fire extinguishing system of claim 1, wherein the pressure controller is configured to generate a signal to activate the release valve.

6. The fire extinguishing system of claim 1, wherein the pressurized container has an internal pressure of 100 bar and the detection conduit has an internal pressure of 24 bar.

7. The fire extinguishing system of claim 6, wherein the predetermined value for the detection conduit is 4 bar.

8. The fire extinguishing system of claim 1, further comprising a fire alarm system that generates an audible alarm and/or a visible alarm, wherein the pressure controller is configured to activate the fire alarm system if the pressure in the detection conduit falls below a predetermined value.

9. A fire extinguishing system for a vehicle engine compartment, the system having a pressurized extinguishing medium, comprising:

a detection conduit at least partially disposed in the vehicle engine compartment, wherein the detection conduit is not gas-tight and is filled only with a liquid, the liquid maintained at a pressure less than that of the pressurized extinguishing medium; and a detection system coupled to the detection conduit, the detection system comprising an interface container coupled to the detection conduit to pressurize the liquid filled detection conduit and a pressure controller to monitor a pressure associated with the interface container; wherein, if a pressure in the detection conduit falls below a predetermined value, the pressurized extinguishing medium is deployed and wherein the pressure controller is configured to generate an electric trigger signal to activate a shut-off function if the pressure in the detection conduit falls below the predetermined value, wherein the shut-off function provides an automatic shut-off of a fuel.

10. The fire extinguishing system of claim 9, wherein the interface container contains a gas space in fluid communication with a pressurized gas source and a liquid space in fluid communication with the detection conduit.

11. The fire extinguishing system of claim 10, wherein the source of the pressurized gas is a gas container that is not in communication with the pressurized extinguishing medium.

12. The fire extinguishing system of claim 10, wherein the source of the pressurized gas is the pressurized extinguishing medium.

13. The fire extinguishing system of claim 10, wherein the gas space and the liquid space of the interface container are separated by a piston, wherein the piston is displaceable within the interface container depending on a level of the liquid.

14. The fire extinguishing system of claim 13, wherein the piston comprises a position sensor for monitoring the position of the piston in the interface container.

15. The fire extinguishing system of claim 13, wherein the piston falling below a predetermined lower position activates a switch that generates a signal to deploy extinguishing medium.

16. The fire extinguishing system of claim 10, wherein the detection conduit is formed from a thermoplastic fluoropolymer.

17. The fire extinguishing system of claim 9, wherein the detection conduit is adapted to operate without rupture when the vehicle engine compartment temperature is 150° C.

18. The fire extinguishing system of claim 9, wherein the fire extinguishing medium is water.

* * * * *